US010711432B2

(12) United States Patent
White et al.

(10) Patent No.: US 10,711,432 B2
(45) Date of Patent: Jul. 14, 2020

(54) METHOD AND APPARATUS FOR FORMING A TRENCH IN A SEA FLOOR

(71) Applicant: Soil Machine Dynamics Limited, Wallsend Tyne and Wear (GB)

(72) Inventors: Roger Paul White, Wallsend Tyne and Wear (GB); John Graeme Walker, Wallsend Tyne and Wear (GB); Simon Vivian Ranulf Bateson, Wallsend Tyne and Wear (GB)

(73) Assignee: Soil Machine Dynamics Limited, Wallsend Tyne and Wear (GB)

( * ) Notice: Subject to any disclaimer, the term of this patent is extended or adjusted under 35 U.S.C. 154(b) by 0 days.

(21) Appl. No.: 16/083,080

(22) PCT Filed: Feb. 24, 2017

(86) PCT No.: PCT/EP2017/054300
§ 371 (c)(1),
(2) Date: Sep. 7, 2018

(87) PCT Pub. No.: WO2017/153184
PCT Pub. Date: Sep. 14, 2017

(65) Prior Publication Data
US 2019/0032303 A1 Jan. 31, 2019

(30) Foreign Application Priority Data
Mar. 8, 2016 (EP) ..... 16159131

(51) Int. Cl.
*E02F 5/02* (2006.01)
*E02F 5/12* (2006.01)
(Continued)

(52) U.S. Cl.
CPC ..... *E02F 5/027* (2013.01); *E02F 5/106* (2013.01); *E02F 5/125* (2013.01); *E02F 5/14* (2013.01); *E02F 5/30* (2013.01)

(58) Field of Classification Search
CPC ..... E02F 5/02; E02F 5/027; E02F 5/12; E02F 5/125
See application file for complete search history.

(56) References Cited

U.S. PATENT DOCUMENTS 2,136,911 A * 11/1938 Briscoe ..... E02F 5/027 37/372
RE20,990 E * 1/1939 Wright ..... E02F 5/027 37/366
(Continued)

FOREIGN PATENT DOCUMENTS

EP 0 296 783 A1 12/1988
EP 2 840 187 A1 2/2015
(Continued)

OTHER PUBLICATIONS

PCT International Searching Authority, International Search Report and Written Opinion for Int'l Appl. No. PCT/EP2017/054300, dated May 11, 2017, 12 pages.
(Continued)

*Primary Examiner* — Matthew Troutman
(74) *Attorney, Agent, or Firm* — Quarles & Brady LLP

(57) ABSTRACT

An apparatus for forming a trench in a sea floor and/or displacing material on the sea floor is disclosed. The apparatus comprises a body and front skids mounted to the body for engaging the sea floor and supporting the body. The front skids are adjustable between a first mode, in which the front skids engage the sea floor, and a second mode, in which the front skids engage the sea floor adjacent the trench and at the trench walls.

12 Claims, 8 Drawing Sheets

(51) Int. Cl.

| | |
|---|---|
| ***E02F 5/14*** | (2006.01) |
| ***E02F 5/10*** | (2006.01) |
| ***E02F 5/30*** | (2006.01) |

(56) References Cited

U.S. PATENT DOCUMENTS

| | | | | | |
|---|---|---|---|---|---|
| 2,849,809 | A * | 9/1958 | Chattin | E02F 3/7663 | 37/372 |
| 3,462,963 | A | 8/1969 | Moore | | |
| 3,526,047 | A * | 9/1970 | Goltz | E02F 5/02 | 37/372 |
| 4,585,372 | A * | 4/1986 | Grinstead | E02F 5/106 | 405/159 |
| 4,802,793 | A * | 2/1989 | Grinsted | E02F 5/104 | 405/159 |
| 9,605,407 | B2 * | 3/2017 | Penner | E02F 3/7604 | |
| 10,323,383 | B2 * | 6/2019 | Wilson | E02F 5/14 | |
| 2014/0150303 | A1 * | 6/2014 | Wilson | E02F 5/106 | 37/342 |
| 2014/0154014 | A1 * | 6/2014 | Wilson | H02G 1/10 | 405/159 |

FOREIGN PATENT DOCUMENTS

| | | | |
|---|---|---|---|
| GB | 2172032 | A | 9/1986 |
| GB | 2355276 | A | 4/2001 |
| RU | 2010139625 | A | 4/2012 |

OTHER PUBLICATIONS

Danish Patent and Trademark Office, Search Report and Opinion, Application No. PA201870577, dated Jul. 12, 2019, 9 pages.

* cited by examiner

METHOD AND APPARATUS FOR FORMING A TRENCH IN A SEA FLOOR

This application represents the U.S. national stage entry of International Application No. PCT/EP2017/054300 filed Feb. 24, 2017, which claims priority to European Patent Application No. 16159131.8 filed Mar. 8, 2016, the disclosure of which is incorporated herein by reference in its entirety and for all purposes.

The present invention relates to a method and apparatus for forming a trench in a sea floor, and relates particularly, but not exclusively, to a method and apparatus for installing a cable in a trench in a sea floor.

It is known to install a cable in a trench in a sea floor by using a boulder clearing apparatus to clear debris such as boulders from the region where the trench is to be formed, and then to tow a trenching plough by a ship to form a trench having sidewalls inclined relative to each other. After the cable is laid in the trench, a backfill apparatus is used to push spoil displaced by formation of the trench into the trench to bury the cable.

This known arrangement suffers from the disadvantage that several separate apparatus are required which significantly increases costs, and in order to bury a cable to a depth of 2.5 meters, the known cable plough operates at a pulling force of 350 tonnes and has a weight of 160 tonnes.

European Patent Application EP 2840187 discloses an apparatus for forming a trench and burying a cable in the trench in which certain parts of the apparatus are interchangeable in order to enable the apparatus to carry out boulder clearing, first pass trenching, full depth trenching and backfilling operations. However, this arrangement suffers from the drawback that a significant number of interchangeable components are required, and the apparatus must be retrieved to the surface in order to enable conversion between at least some of the different modes of the apparatus to take place.

Preferred embodiments of the present invention seek to overcome one or more of the above disadvantages of the prior art.

According to an aspect of the present invention, there is provided an apparatus for forming a trench in a sea floor and/or displacing material on the sea floor, the apparatus comprising:— a body; and sea floor engaging means mounted to the body for engaging the sea floor and supporting the body;

wherein the sea floor engaging means is adjustable between a first mode of said sea floor engaging means, in which the sea floor engaging means engages the sea floor, and a second mode of the sea floor engaging means, in which the sea floor engaging means engages the sea floor adjacent the trench and at least one wall of the trench.

By providing sea floor engaging means adjustable between a first mode of said sea floor engaging means, in which the sea floor engaging means engages the sea floor, and a second mode of the sea floor engaging means, in which the sea floor engaging means engages the sea floor adjacent the trench and at least one wall of the trench, this provides the advantage of improved control of the apparatus in the first and second modes of the apparatus, without the necessity of changing the sea floor engaging means. This in turn reduces the cost of components of the apparatus, while also reducing the cost of operation of the apparatus, by reducing the time during which the apparatus need to be recovered to the surface to exchange the sea floor engaging means.

The apparatus may further comprise trench cutting means supported by the body for cutting a trench in a sea floor.

The sea floor engaging means may comprise at least one skid.

At least one said skid may have a first portion for engaging the sea floor in said first and second modes, and a second portion, pivotable relative to said first portion, for engaging the sea floor in said first mode and engaging a wall of the trench in said second mode.

This provides the advantage of providing a lower cost, simplified construction of the skid, which is easy to adjust.

The height of the sea floor engaging means may be adjustable relative to the body.

This provides the advantage of enabling the depth of the trench cutting means to be adjusted.

According to another aspect of the present invention, there is provided an apparatus for forming a trench in a sea floor and/or displacing material on the sea floor, the apparatus comprising:

a body;

trench cutting means supported by the body for cutting a trench in the sea floor;

sea floor engaging means mounted to the body for engaging the sea floor and supporting the body; and material displacing means for displacing material on the sea floor as a result of movement of the apparatus along the trench, wherein the material displacing means is adjustable between a first mode of the material displacing means, in which material removed from the trench is displaced laterally away from the trench, and a second mode of the material displacing means, in which material adjacent the trench is displaced into the trench.

By providing material displacing means for displacing material on the sea floor as a result of movement of the apparatus along the trench, wherein the material displacing means is adjustable between a first mode of the material displacing means, in which material removed from the trench is displaced laterally away from the trench, and a second mode of the material displacing means, in which material adjacent the trench is displaced into the trench, this provides the advantage of enabling separate debris clearing and backfilling operations to be carried out by a single apparatus, thereby reducing component cost, and reducing the cost of operation of the apparatus, by while also reducing the cost of operation of the apparatus, by reducing the time during which the apparatus need to be recovered to the surface to exchange a material displacing means suitable for one of the first and second modes for a material displacing means suitable for the other of the first and second modes.

The material displacing means may comprise a plurality of first material displacement members pivotable between said first and second modes of the material displacement means.

The apparatus may further comprise restraining means for restraining outward pivoting of said first material displacement members relative to the body in said second mode of the material displacing means.

According to a further aspect of the present invention, there is provided an apparatus for forming a trench and/or inserting material into a trench in a sea floor, the apparatus comprising:

a body;

sea floor engaging means mounted to the body for engaging the sea floor and supporting the body; and material displacing means for displacing material on the sea floor as a result of movement of the apparatus along the sea floor, wherein the material displacing means comprises a plurality of first material displacement members mounted to the body, and a plurality of second material displacement members mounted to the first material displacement members in a first mode of the material displacing means such that a lateral width of the apparatus in said first mode of the material displacing means is larger than the lateral with of the apparatus in a second mode of the material displacing means.

By providing material displacing means for displacing material on the sea floor as a result of movement of the apparatus along the sea floor, wherein the material displacing means comprises a plurality of first material displacement members mounted to the body, and a plurality of second material displacement members mounted to the first material displacement members in a first mode of the material displacing means such that a lateral width of the apparatus in said first mode of the material displacing means is larger than the lateral with of the apparatus in a second mode of the material displacing means, this provides the advantage of ensuring more efficient operation of the apparatus by enabling debris clearance and/or backfilling to be carried out over a wider path than is covered by a trenching operation, thereby reducing the tendency of large debris to be inserted into the trench in the backfilling operation. The apparatus also enables the width of the apparatus during deployment from the surface to be reduced, thereby making deployment from and recovery to the surface easier.

The apparatus may further comprise trench cutting means supported by the body for cutting a trench in the sea floor.

At least one said second material displacement member may be pivotably mounted to a respective said first material displacement member.

The material displacing means may further be adapted to displace material on the sea floor, forwards of the sea floor engaging means, laterally outwards of the apparatus.

This provides the advantage of further assisting the debris clearing operation.

The material displacing means may be adapted to displace material by means of at least one third material displacing member mounted to said body.

The third material displacing member may be removable.

A preferred embodiment of the invention will now be described, by way of example only and not in any limitative sense, with reference to the accompanying drawings, in which.

Figure 1:
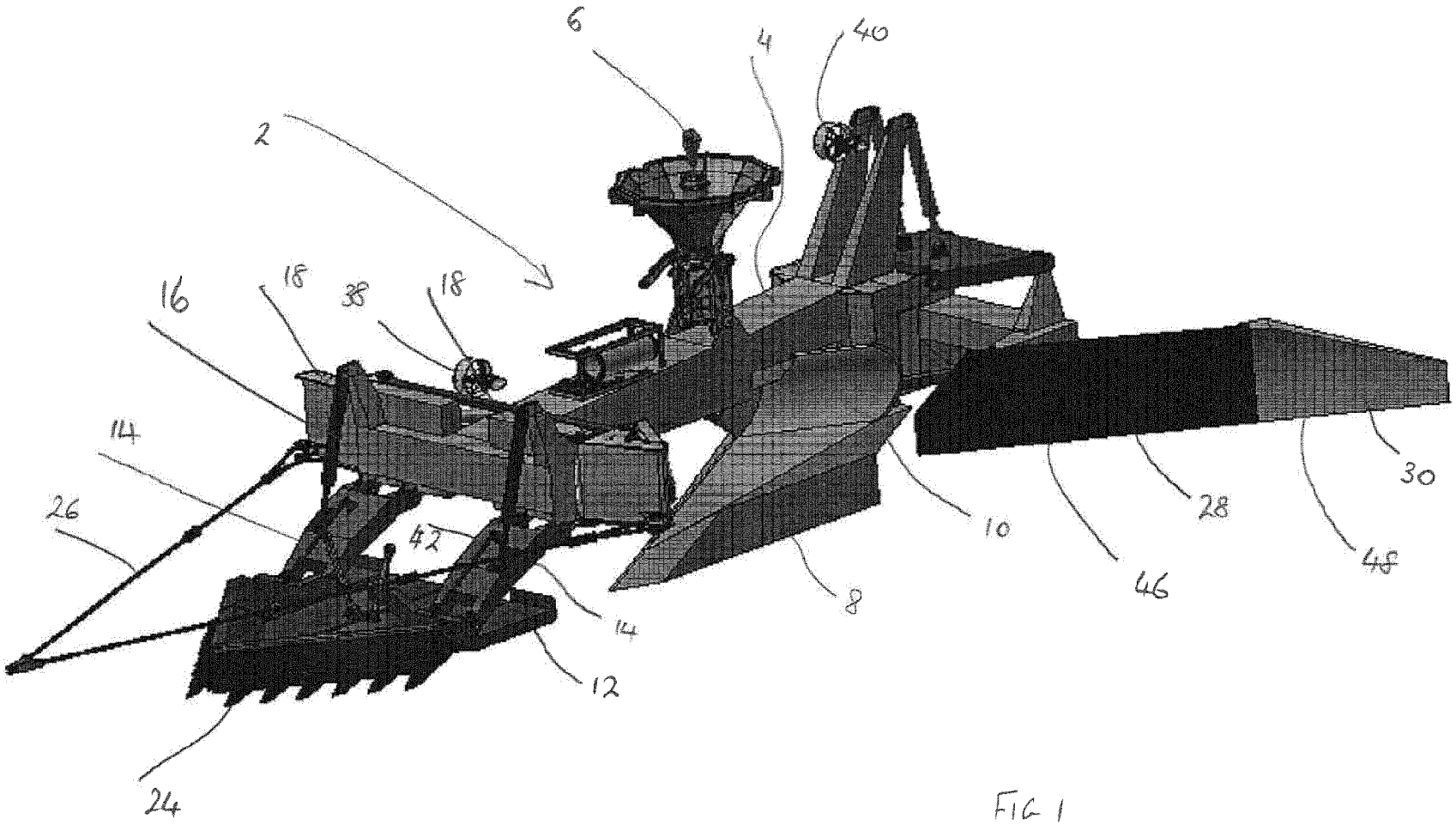
FIG. 1 is a perspective view of a trenching apparatus embodying the present invention in a debris clearing and first pass trenching mode thereof.
Figure 4:
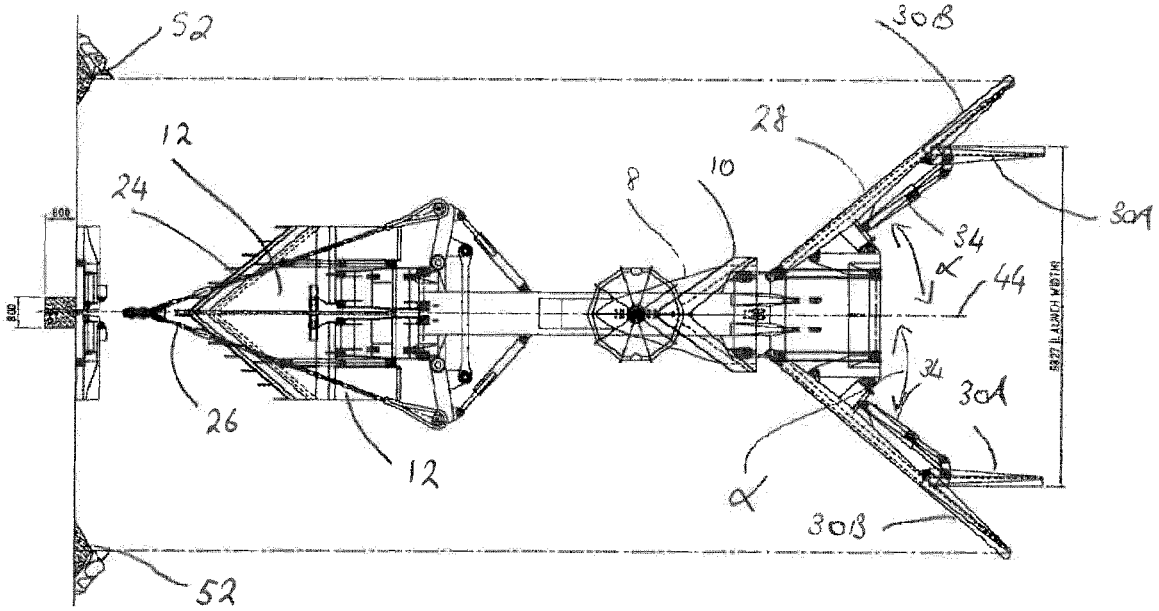
FIG. 4 is a plan view of the apparatus of FIG. 1.
Figure 7:
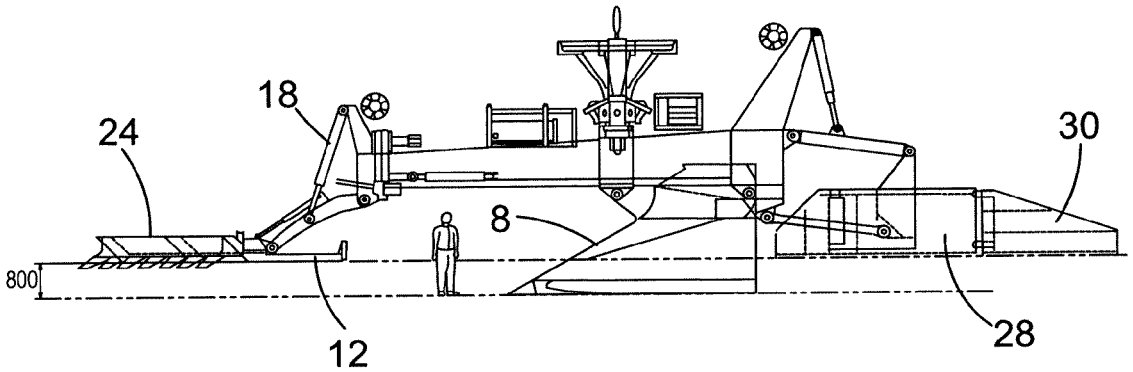
FIG. 7 is a side view of the apparatus of FIG. 4.

Referring to FIGS. 1, 4 and 7, a universal plough 2 for clearing debris such as boulders from a region of a sea floor where a trench is to be formed, and cutting part of the trench in a first pass, is shown in a debris clearing mode of the plough 2. The plough 2 has a body 4 having a single point lift attachment 6 for connection to a lift wire (not shown) for enabling deployment of the plough 2 to the sea floor from a surface vessel (not shown), or recovery of the plough 2 from the sea floor to the surface vessel. The plough is controlled by means of electrical power supplied by means of an umbilical cable (not shown).

The body 4 supports trench cutting means in the form of a plough share 8 and a pair of fixed mouldboards 10 are located above the plough share 8 for displacing soil out of a trench formed by the plough share 8 as the plough 2 is towed forwards. The body 4 also supports sea floor engaging means in the form of a pair of front skids 12 pivotably mounted via links 14 to a beam 16, which is in turn pivotably mounted to the front of the body 4. Each of the front skids 12 can be raised and lowered relative to the body 4 by means of a respective hydraulic actuator 18, and has a fixed first part 20, and a second part 22 pivotably mounted to the first part 20, the operation of which will be described in greater detail below with reference to FIGS. 3 and 12 to 14. A debris clearing member 24 is removably attached to the front skids 12, and a towing cable 26 is attached to each end of the beam 16 to enable towing of the plough 2.

Figure 3:
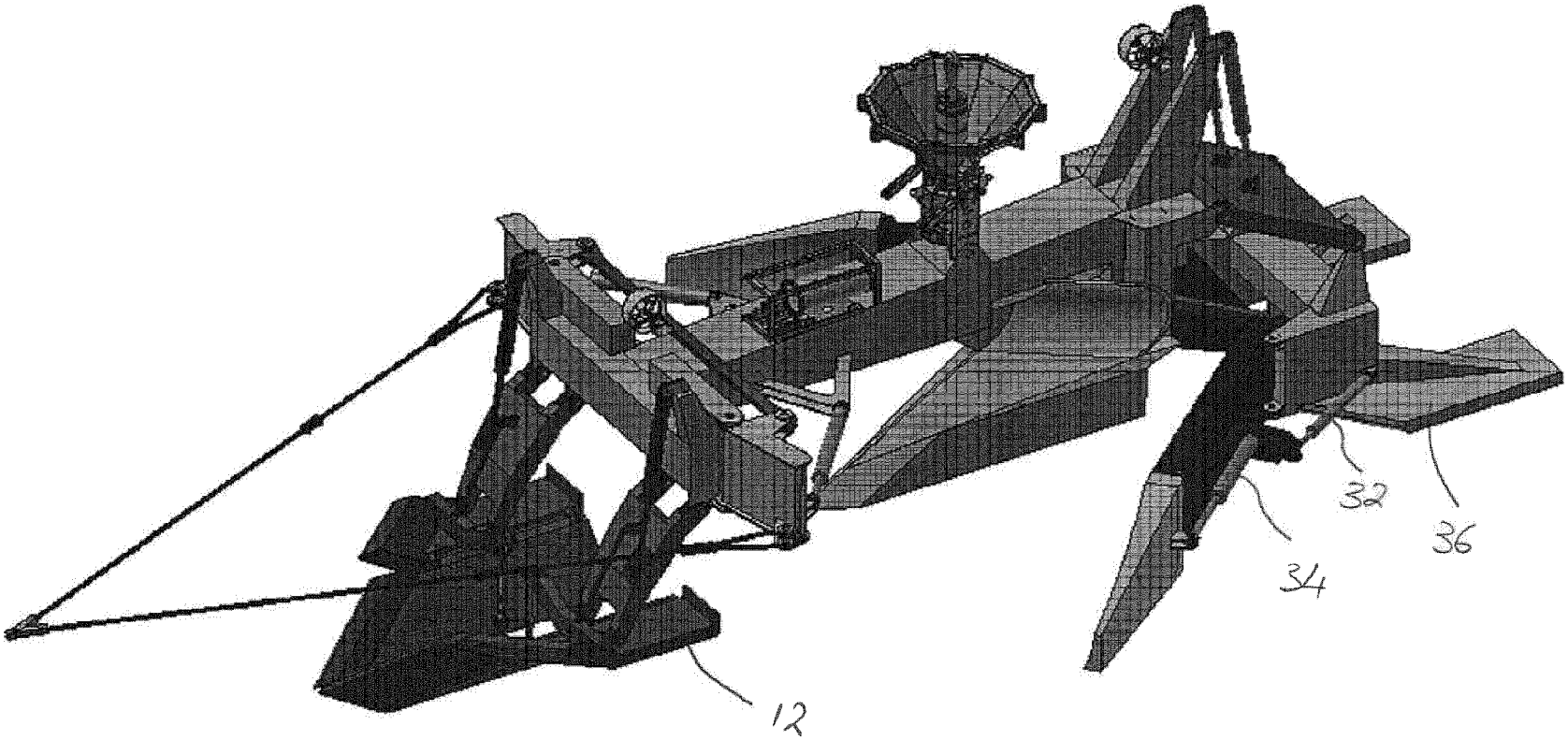
FIG. 3 is a perspective view of the apparatus of FIG. 1 in a backfilling mode thereof.

Material displacing means includes first material displacement members in the form of a pair of pivotable mouldboards 28 pivotably mounted to the body 4 to the rear of the plough share 8 and the fixed mouldboards 10, and second material displacement members in the form of a pair of mouldboard extensions 30 pivotably mounted to the pivotable mouldboards 28. The pivotable mouldboards 28 are pivotable relative to the body 4 by means of hydraulic actuators 32, and the mouldboard extensions 30 are pivotable relative to the pivotable mouldboards 28 by means of hydraulic actuators 34 (FIG. 3). The body 4 is further supported on the sea floor by a pair of rear skids 36 (FIG. 3). A pair of pivotable thrusters 38, 40 enable control of the orientation of the plough 2 while it is supported by the lift wire before coming into contact with the sea bed.

The operation of the plough 2 in a debris clearing and first pass trenching mode will now be described.

Figure 5:
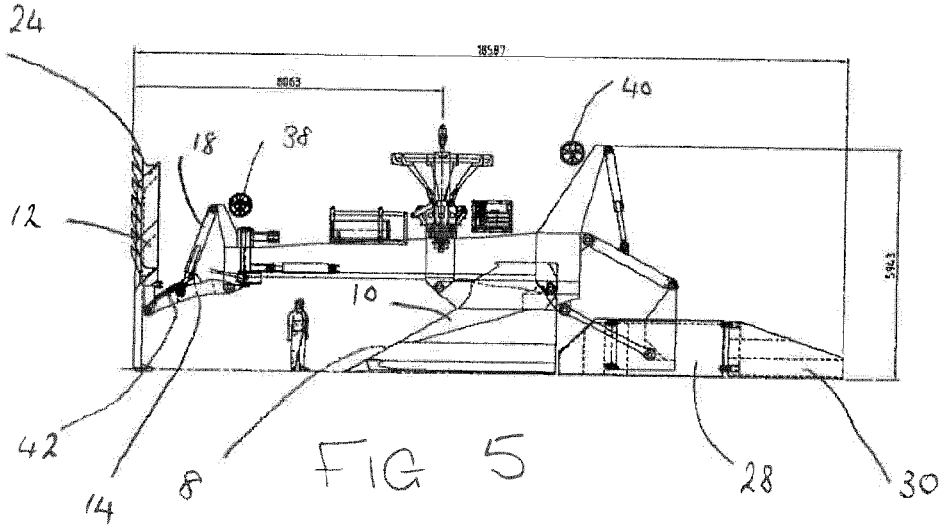
FIG. 5 is a side elevational view of the apparatus of FIG. 4 configured for launching from or recovery to a surface vessel.

Referring to FIG. 5, in a launch/recovery configuration, the front skids 12 of the plough 2, together with the debris clearing member 24, are pivoted relative to the body 4 into a generally vertical orientation by means of hydraulic actuators 42 connected between the front skids 12 and the links 14, to reduce the overall length of the plough 2. The lateral width of the plough 2 is also reduced by pivoting the mouldboard extensions 30 by means of hydraulic actuators 34 to that the mouldboard extensions are arranged in an orientation 30A (FIG. 4) generally parallel to a longitudinal axis 44 of the plough 2.

Figure 6:
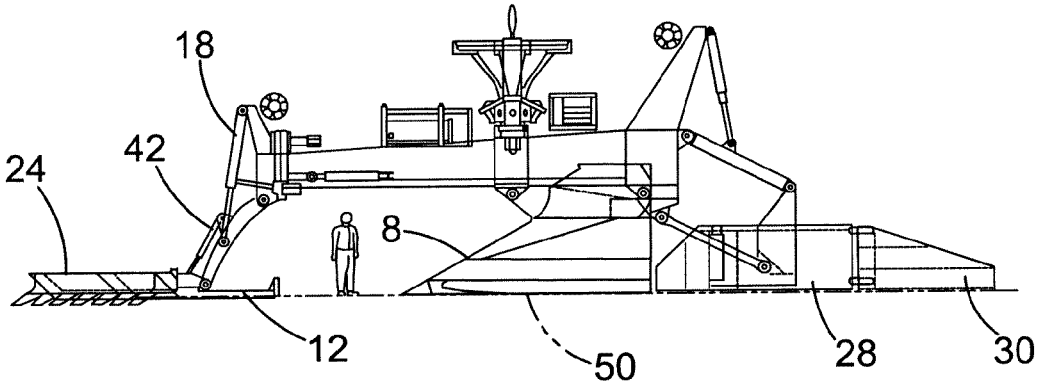
FIG. 6 is a view corresponding to FIG. 5 of the apparatus in a configuration for landing on the sea floor.

The plough 2 is then lowered from the surface vessel to the seabed, and as it approaches the seabed, the front skids 12 together with debris clearing member 24 are lowered to a generally horizontal orientation as shown in FIG. 6 by means of the hydraulic actuators 42. The mouldboard extensions 30 are also pivoted relative to the pivotable mouldboards 28 by means of hydraulic actuators 34 to take up the orientation 30B shown in FIG. 4, so that a front surface 46 of each pivotable mouldboard 28 generally forms a continuous surface with a front surface 48 of the corresponding mouldboard extension 30. The pivotable mouldboards are pivoted relative to the body 4 by means of hydraulic actuators 32 so that the pivotable mouldboards 28 and mouldboard extensions 30 are arranged at an angle α to the longitudinal axis 44, as shown in FIG. 4.

When the plough 2, now in the configuration shown in FIG. 6, rests on seabed 50, the front skids 12 and debris clearing member 24 are raised relative to the plough share 8 by means of hydraulic actuators 18, so that the plough share 8 penetrates the seabed 50 when the plough 2 is towed forwards, as shown in FIG. 7.

The surface vessel (not shown) then tows the plough 2 via towing cable 26, and debris located forwards of the front skids 12 is displaced out of the path of the front skids 12 by the debris clearing member 24. In addition, debris is displaced laterally of the plough 2 by pivotable mouldboards 28 and mouldboard extensions 30 to form first debris heaps 52 on both sides of the plough 2.

On completion of the first pass cutting of the trench by the plough 2 in the configuration shown in FIG. 7, the plough 2 is raised from the seabed 50, returned to its launch/recovery configuration shown in FIG. 5, and is then recovered to the surface vessel where the debris clearing member 24 is removed from the front skids 12. The mouldboard extensions 30 are either removed from the pivotable mouldboards 28 or are pivoted relative to the pivotable mouldboards 28 by means of hydraulic actuators 34 so that they are located behind the pivotable mouldboards 28. The plough is then in the configuration shown in FIG. 9 and is returned to the seabed 50 to the trench formed in the first pass trenching operation described above.

Figure 2:
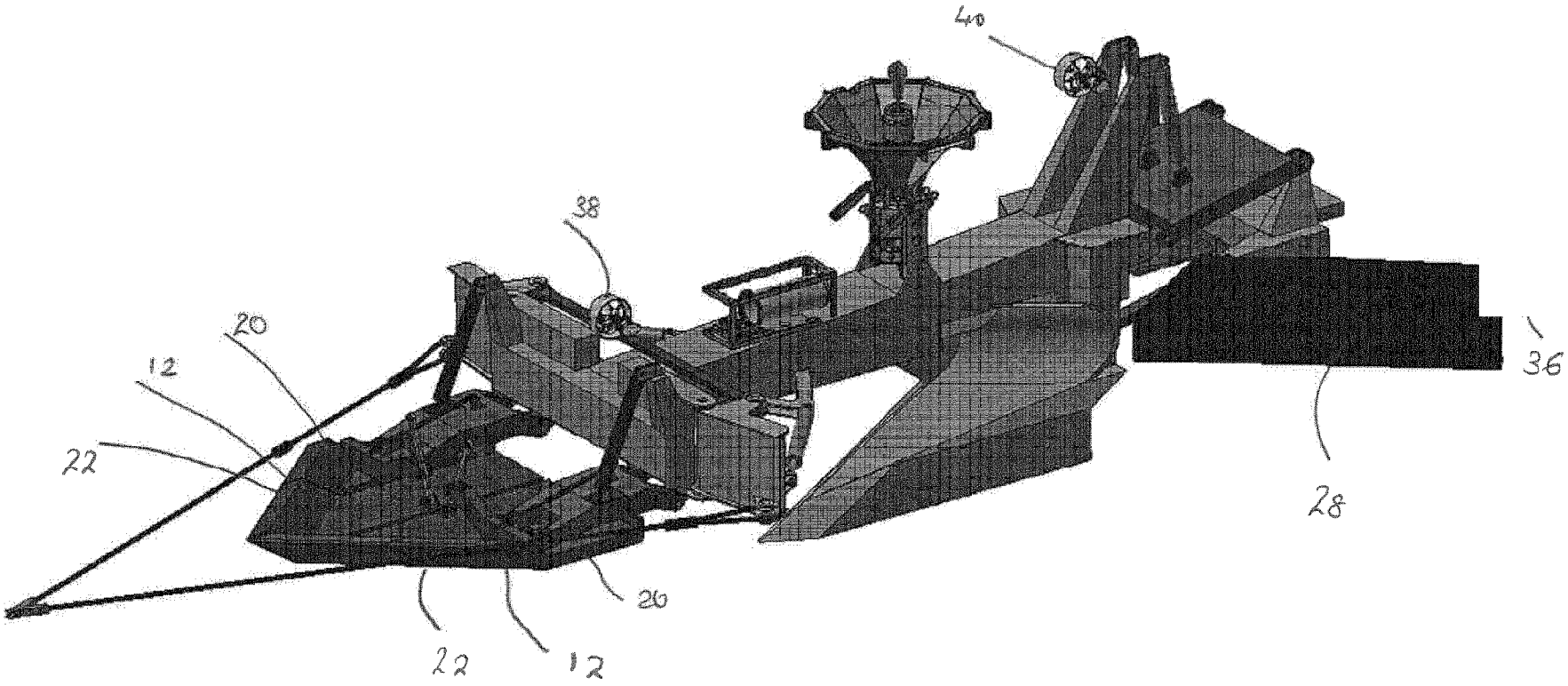
FIG. 2 is a perspective view of the apparatus of FIG. 1 in a full depth trenching mode thereof.
Figure 10:
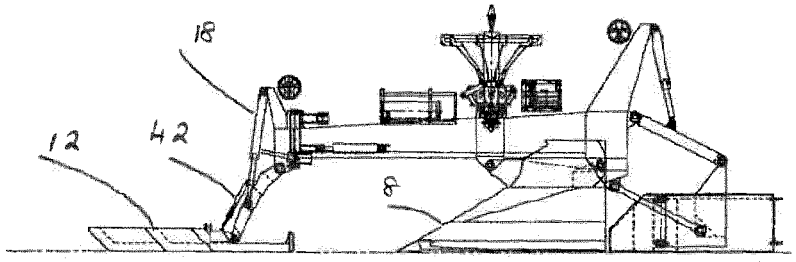
FIG. 10 is a view corresponding to FIG. 9 of the apparatus in a configuration for landing on the sea floor.
Figure 11:
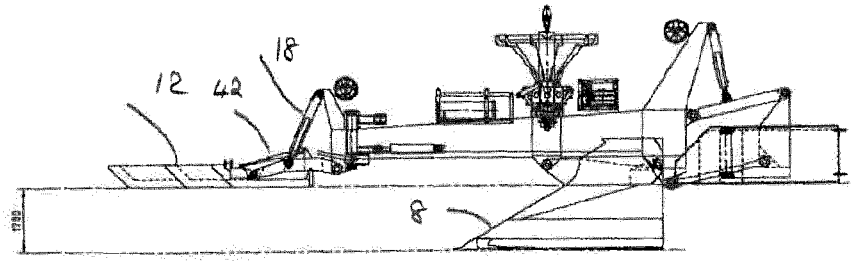
FIG. 11 is a side view of the apparatus of FIG. 8.

As the plough approaches the seabed 50, the front skids 12 are rotated to a generally horizontal orientation by means of the hydraulic actuators 42 to provide the configuration shown in FIG. 10. The front skids 12 are then raised relative to the plough share 8 by means of hydraulic actuators 18 so that the plough share 8 can penetrate the seabed 50 to a greater depth than in the configuration shown in FIG. 1 to enable the plough 2 to operate in its full depth trenching mode as shown in FIGS. 2 and 11.

The operation of the plough 2 in a full depth trenching mode will now be described.

Figure 8:
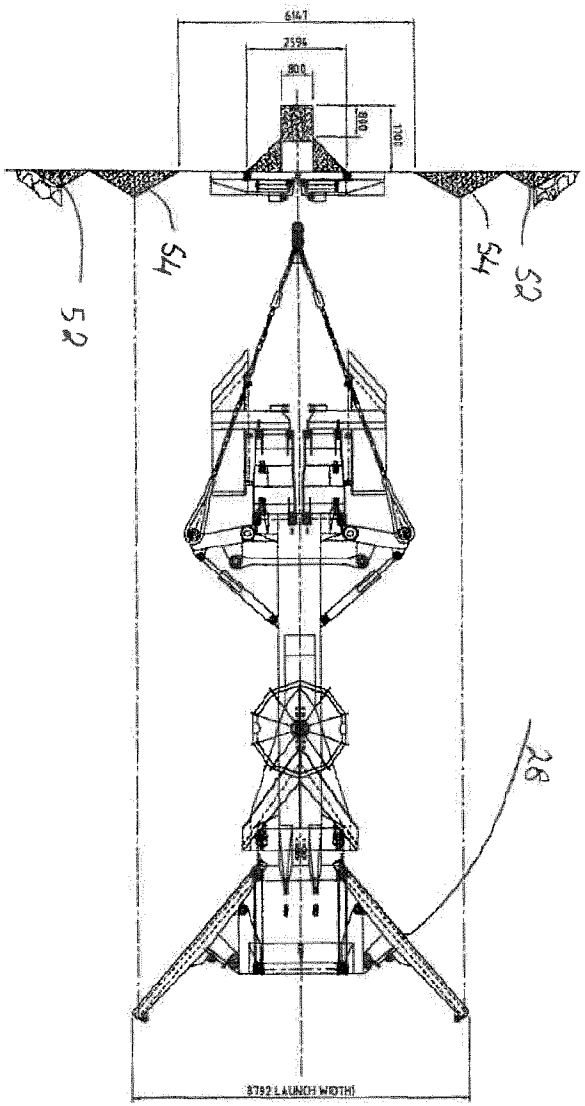
FIG. 8 is a plan view of the apparatus of FIG. 2.

The plough 2 is towed by the surface vessel so that second pass cutting of the trench is carried out in which the plough 8 share cuts the trench to its full depth. Soil displaced from the trench by the plough share 8 is displaced laterally away from the trench by fixed mouldboards 10 and then by pivotable mouldboards 28 to form second debris heaps 54 (FIG. 8) on both sides of the plough 2. Because the mouldboard extensions 30 do not contribute to material displacement from the trench in the full depth trenching mode, the second debris heaps 54 are located laterally inwards of the first debris heaps 52. At the same time, a cable (not shown) to be installed in the trench is guided into the trench.

Figure 9:
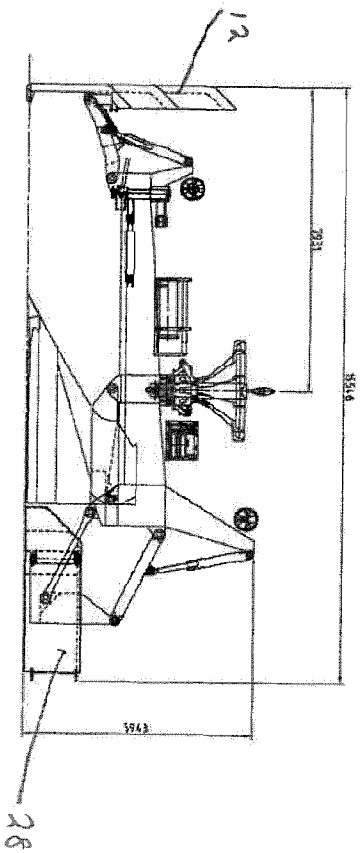
FIG. 9 is a side elevational view of the apparatus of FIG. 8 configured for launching from or recovery to a surface vessel.
Figure 12:
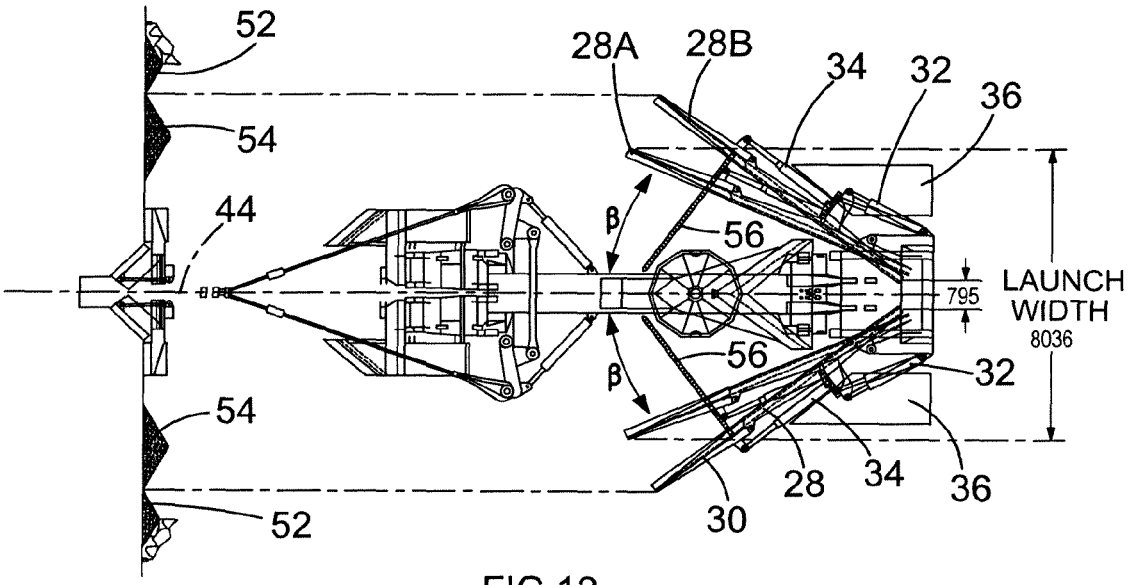
FIG. 12 is a plan view of the apparatus of FIG. 3.

On completion of the full depth trenching process, the plough 2 is returned to its launch/recovery configuration as shown in FIG. 9 and then recovered to the surface vessel for reattachment of the mouldboard extensions 30, if they have been removed for the full depth trenching mode, and for reconfiguration of the plough 2 to its backfilling mode as shown in FIG. 3. The mouldboard extensions 30 are arranged so that the front surface 48 of each mouldboard extension 30 forms a generally continuous surface with the front surface 46 of the corresponding pivotable mouldboard 28, and the pivotable mouldboards 28 are pivoted forwards of the body 4 by means of hydraulic actuators 32 so that the pivotable mouldboards 28 and mouldboard extensions 30 are arranged at an angle β to the longitudinal axis 44 of the plough 2, to take up the orientation 28A as shown in FIG. 12. The angle β shown in FIG. 12 is smaller than the angle α shown in FIG. 4. Restraining members 56 prevent the pivotable mouldboards 28 from pivoting outwards relative to the body 4 beyond the orientation 28B shown in FIG. 12.

The operation of the plough 2 in a backfilling mode will now be described.

Figure 13:
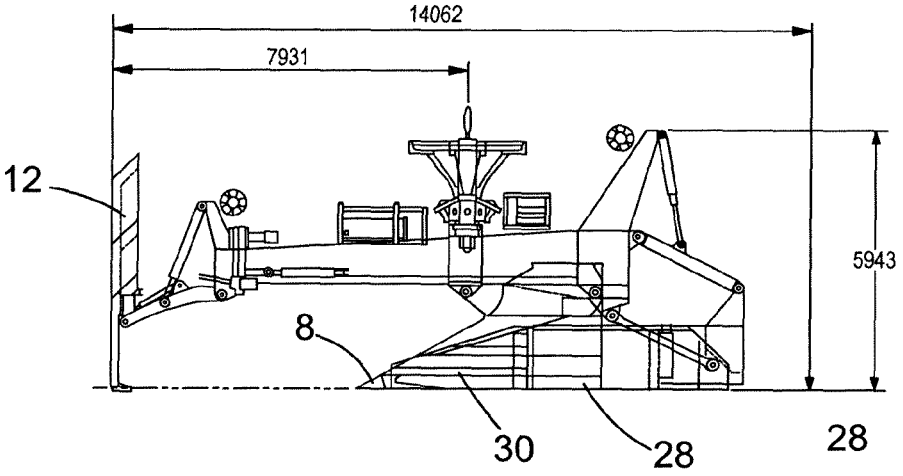
FIG. 13 is a side elevational view of the apparatus of FIG. 12 configured for launching from or recovery to a surface vessel.

The front skids 12 are pivoted to a generally vertical orientation as shown in FIG. 13 by means of hydraulic actuators 42 to place the plough in its launch/recovery configuration. The plough 2 is then returned to the seabed in its launch/recovery configuration as shown in FIG. 13, and shortly before arrival at the seabed 50, the front skids 12 are lowered to a generally horizontal orientation by means of the hydraulic actuators 42 to bring the plough 2 into a landing configuration. The second parts 22 of the front skids 12 are then pivoted relative to the first parts 20 to bring the front skids 12 into the configuration shown in FIG. 3. The front skids 12 are then located in the top of the trench so that the first parts 20 engage the seabed 50 adjacent the trench and the second parts 22 engage the upper parts of the sidewalls of the trench to more reliably locate the skids 12 in engagement with the trench as the plough 2 is towed forwards.

Figure 14:
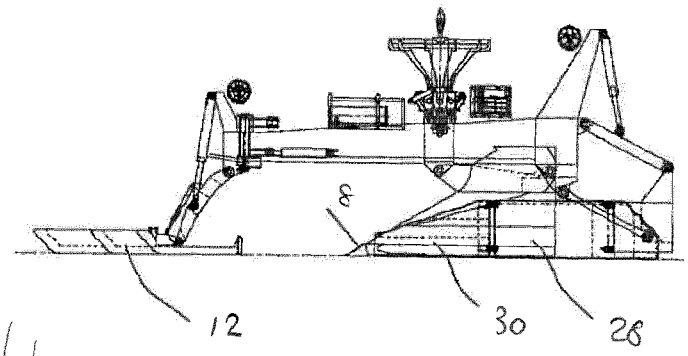
FIG. 14 is a side view of the apparatus of FIG. 12.

The front skids 12 are then raised relative to the body 4 by means of hydraulic actuators 18 to bring the plough into the configuration shown in FIG. 14 so that the plough share 8 does not enter the trench to its full depth. The plough 2, supported by the front skids 12 and rear skids 36, is then towed along the trench containing the cable and the pivotable mouldboards 28 together with mouldboard extensions 30 displace relatively finer soil located in the second debris heaps 54 (FIG. 12) into the trench to bury the cable in the trench, while leaving the first debris heaps 52, containing relatively coarser soil, generally undisturbed, since the mouldboard extensions 30 extend laterally outwards from the plough 2 to a lesser extent in the backfilling mode of FIG. 3 than in the debris clearing mode of FIG. 1, because the angle β is smaller than the angle α.

It will be appreciated by persons skilled in the art that the above embodiment has been described by way of example only and not in any limitative sense, and that various alterations and modifications are possible without departure from the scope of the invention as defined by the appended claims.

The invention claimed is:

1. An apparatus for forming a trench and/or inserting material into a trench in a sea floor, the apparatus comprising:

a body;

at least one sea floor engaging device mounted to the body for engaging the sea floor and supporting the body;

at least one material displacing device for displacing material on the sea floor as a result of movement of the apparatus along the sea floor, wherein at least one said material displacing device comprises a plurality of first material displacement members mounted to the body, and a plurality of second material displacement members mounted to the first material displacement members in a first mode of the material displacing device such that a lateral width of the apparatus in said first mode of the material displacing device is larger than the lateral width of the apparatus in a second mode of the material displacing device; and at least one trench cutting device supported by the body for cutting a trench in the sea floor;

wherein at least one said material displacing device comprises a plurality of tines adapted to displace material on the sea floor, forwards of at least one said sea floor engaging device, laterally outwards of the apparatus, while at least one said trench cutting device is cutting a trench in the sea floor.

2. An apparatus according to claim 1, wherein at least one said sea floor engaging device is adjustable between a first mode of said sea floor engaging device, in which the sea floor engaging device engages the sea floor, and a second mode of the sea floor engaging device, in which the sea floor engaging device engages the sea floor adjacent the trench and at at least one wall of the trench.

3. An apparatus according to claim 2, wherein at least one said sea floor engaging device comprises at least one skid.

4. An apparatus according to claim 3, wherein at least one said skid has a first portion for engaging the sea floor in said first and second modes, and a second portion, pivotable relative to said first portion, for engaging the sea floor in said first mode and engaging a wall of the trench in said second mode.

5. An apparatus according to claim 1, wherein the height of at least one said sea floor engaging device is adjustable relative to the body.

6. An apparatus according to claim 1, wherein at least one said material displacing device is adjustable between a first mode of the material displacing device, in which material removed from the trench is displaced laterally away from the trench, and a second mode of the material displacing device, in which material adjacent the trench is displaced into the trench.

7. An apparatus according to claim 6, wherein at least one said material displacing device comprises a plurality of first material displacement members pivotable between said first and second modes of the material displacement device.

8. An apparatus according to claim 7, further comprising at least one restraining device for restraining outward pivoting of said first material displacement members relative to the body in said second mode of the material displacing device.

9. An apparatus according to claim 1, wherein at least one said second material displacement member is pivotably mounted to a respective said first material displacement member.

10. An apparatus according to claim 1, wherein at least one said material displacing device is adapted to displace material by means of at least one third material displacing member mounted to said body.

11. An apparatus according to claim 10, wherein the third material displacing member is removable.

12. An apparatus according to claim 1, wherein said tines project downwardly and point forwardly from the material displacing device in use.

* * * * *